US008303401B2

(12) United States Patent
Yoshimura

(10) Patent No.: US 8,303,401 B2
(45) Date of Patent: Nov. 6, 2012

(54) PROGRESSIVE JACKPOT SYSTEM ACCELERATING INCREMENT RATE OF JACKPOT VALUE

(75) Inventor: Toshiyuki Yoshimura, Zama (JP)

(73) Assignee: Konami Gaming, Incorporated, Las Vegas, NV (US)

( * ) Notice: Subject to any disclaimer, the term of this patent is extended or adjusted under 35 U.S.C. 154(b) by 1549 days.

(21) Appl. No.: 11/616,262

(22) Filed: Dec. 26, 2006

(65) Prior Publication Data

US 2008/0153587 A1 Jun. 26, 2008

(51) Int. Cl.

| | |
|---|---|
| ***A63F 9/24*** | (2006.01) |
| ***A63F 13/00*** | (2006.01) |
| ***G06F 17/00*** | (2006.01) |
| ***G06F 19/00*** | (2011.01) |

(52) U.S. Cl. ..... 463/27; 463/25; 463/26; 463/28

(58) Field of Classification Search ..... 463/25–28
See application file for complete search history.

(56) References Cited

U.S. PATENT DOCUMENTS

| | | | | |
|---|---|---|---|---|
| 4,844,464 | A * | 7/1989 | Berge | 463/27 |
| 5,116,055 | A | 5/1992 | Tracy | |
| 5,951,011 | A * | 9/1999 | Potter et al. | 273/292 |
| 2007/0060314 | A1 * | 3/2007 | Baerlocher et al. | 463/25 |

* cited by examiner

*Primary Examiner* — Michael Cuff
*Assistant Examiner* — Kevin Y Kim
(74) *Attorney, Agent, or Firm* — Global IP Counselors, LLP

(57) ABSTRACT

A progressive jackpot (PJP) system of the invention increments two types of jackpot values. A PJP controller increments a first jackpot value by a percentage of each bet placed on gaming machines. The increment rate of the first jackpot value is predetermined from a payout percentage of the PJP system. A second jackpot value is incremented at a higher rate than the first jackpot value. Each gaming machine or the PJP controller may increment the second jackpot value. The actual amount of an award for a jackpot corresponds to the second jackpot value. The second jackpot value is reduced at appropriate intervals, even if no jackpot has been won. Preferably, the probability of the reduction of the second jackpot value is adjusted, and thereby, the average difference between the first and second jackpot values at the time a jackpot has been won is adjusted to be zero.

17 Claims, 8 Drawing Sheets

PROGRESSIVE JACKPOT SYSTEM ACCELERATING INCREMENT RATE OF JACKPOT VALUE

BACKGROUND OF THE INVENTION

1. Field of the Invention

The present invention relates to a gaming system, and in particular, a progressive jackpot system that allows a gaming machine to provide a progressive jackpot.

2. Background Information

The value of a jackpot is one of the most attractive features for players who select gaming machines in a casino. The higher the jackpot value is, the more attractive a gaming machine is. In general, one or more gaming machines are linked to a common jackpot controller, and constitute a single jackpot system. The jackpot controller uses a lottery process to determine whether or not to provide a jackpot for one of the linked gaming machines. In a progressive jackpot system, a progressive jackpot controller repeatedly increments a jackpot value by a percentage of each bet on gaming machines linked to the progressive jackpot controller until one of the gaming machines wins a jackpot (cf. U.S. Pat. No. 5,116,055). The increasing jackpot value is displayed on each of the gaming machines. The higher the jackpot value rises, the more players are attracted to the gaming machines. Accordingly, the increasing pace of the jackpot value is further accelerated with time. This further attracts the players to the gaming machines in the progressive jackpot system.

When one of the gaming machines has won a jackpot, the jackpot value is reset to a default value. The increment of the jackpot value is actually equal to a percentage of each bet placed on any of the gaming machines in the progressive jackpot system. While the jackpot value is low, fewer players are attracted to play games on the gaming machines. Accordingly, the jackpot value is increased at a relatively slow pace. This further lowers players' motivation to play on the gaming machines in the progressive jackpot system. On the other hand, the payout percentage of the progressive jackpot system set to be maintained at a desired level prevents the increase in the increment rate of the jackpot value to a desirable level. Therefore, it is difficult to reduce the period of time during which the jackpot value is low, and thereby improve the occupancy rates of the gaming machines.

In view of the above, it will be apparent to those skilled in the art from this disclosure that there exists a need for an improved progressive jackpot system which can improve the occupancy rates of gaming machines, while the payout percentage of the progressive jackpot system is maintained at a desired level. This invention addresses this need in the art as well as other needs, which will become apparent to those skilled in the art from this disclosure.

SUMMARY OF THE INVENTION

A progressive jackpot system according to the present invention comprises one or more gaming machines and a progressive jackpot controller that are linked to each other. One of the gaming machines may be equipped with the progressive jackpot controller. Preferably, each of the gaming machines and the progressive jackpot controller may execute respective program products, which comprise modules of functions that the following units perform.

According to one aspect of the present invention, the progressive jackpot controller comprises a bet checking unit, a lottery unit, a first jackpot value increment unit, and a jackpot informing unit. The bet checking unit is configured to detect a bet placed by a player on any of the gaming machines. The lottery unit is configured to determine whether or not to provide a jackpot to one of the gaming machines under a lottery process each time the bet checking unit detects a bet. The first jackpot value increment unit is configured to increment a first jackpot value at a predetermined rate each time the bet checking unit detects a bet. The jackpot informing unit is configured to inform one of the gaming machines that it has won a jackpot after the lottery unit has determined to provide the jackpot to the gaming machine.

Each of the gaming machines comprises a jackpot checking unit, a second jackpot value increment unit, a jackpot meter unit, and a jackpot payout unit. The jackpot checking unit is configured to inform the progressive jackpot controller of a bet placed by a player. The jackpot checking unit is further configured to check the information from the jackpot informing unit of the progressive jackpot controller as to whether or not the lottery unit of the progressive jackpot controller has determined to provide a jackpot to one of the gaming machines. The second jackpot value increment unit is configured to monitor the changes in the first jackpot value made by the first jackpot value increment unit of the progressive jackpot controller, and increment a second jackpot value at a rate higher than the increment rate of the first jackpot value in synchronization with the first jackpot value increment unit. The second jackpot value increment unit is further configured to reduce the second jackpot value when the jackpot checking unit detects that the lottery unit of the progressive jackpot controller has determined to provide a jackpot to one of gaming machines. The jackpot meter unit is configured to display the second jackpot value. The jackpot payout unit is configured to produce an output that indicates the winning of a jackpot of the second jackpot value after the jackpot checking unit detects that the lottery unit of the progressive jackpot controller has determined to provide a jackpot to the gaming machine including the jackpot payout unit.

According to another aspect of the present invention, the progressive jackpot controller comprises a bet checking unit, a lottery unit, a jackpot value increment unit, and a jackpot informing unit. The bet checking unit is configured to detect a bet placed by a player on any of the gaming machines. The lottery unit is configured to determine whether or not to provide a jackpot to one of the gaming machines under a lottery process each time the bet checking unit detects a bet. The jackpot value increment unit is configured to increment first and second jackpot values at lower and higher rates, respectively, each time the bet checking unit detects a bet. The jackpot value increment unit is further configured to reduce both the first and second jackpot values when the lottery unit has determined to provide a jackpot to one of the gaming machines. The jackpot informing unit is configured to inform one of the gaming machines that it has won a jackpot of the second jackpot value, after the lottery unit determines to provide the jackpot to the gaming machine.

Each of the gaming machines comprises a jackpot checking unit, a jackpot meter unit, and a jackpot payout unit. The jackpot checking unit is configured to inform the progressive jackpot controller of a bet placed by a player, and check the information from the jackpot informing unit of the progressive jackpot controller as to whether or not the lottery unit of the progressive jackpot controller has determined to provide a jackpot to one of the gaming machines. The jackpot meter unit is configured to monitor and display the second jackpot value changed by the jackpot value increment unit of the progressive jackpot controller. The jackpot payout unit is configured to produce an output that indicates the winning of a jackpot of the second jackpot value when the jackpot checking unit detects that the lottery unit of the progressive jackpot controller has determined to provide a jackpot for the gaming machine including the jackpot payout unit.

In the above-described progressive jackpot systems according to the present invention, the progressive jackpot controller increments the first jackpot value each time the bet is detected on any of the gaming machines. The increment rate of the first jackpot value is predetermined from a desired payout percentage of the progressive jackpot system. On the other hand, another jackpot value (the second jackpot value) is incremented at a higher rate than the first jackpot value. The increment rate of the second jackpot value is essentially free from the desired payout percentage, i.e., it is allowed to be sufficiently higher than a percentage of a bet put into a pool for a jackpot. Here, each of the gaming machines or the progressive jackpot controller may increment the second jackpot value in synchronization with the incrementing of the first jackpot value. The amount of award corresponding to the second jackpot value is actually displayed on the gaming machines and actually paid to a player who has won a jackpot. The second jackpot value requires fewer number of plays on the gaming machines than the first jackpot value in order to return to a sufficiently high level after a jackpot has been won. This prevents players from losing the motivation to play on the gaming machines immediately after a jackpot has been won, and thereby reduce the period of time during which the second jackpot value is low, and improves the occupancy rates of the gaming machines.

Preferably, the (second) jackpot value increment unit is configured to reduce the second jackpot value when the jackpot checking unit has not yet detected that the lottery unit has determined to provide a jackpot to any of the gaming machines, and thereby adjust the difference between the first and second jackpot values at the time a jackpot has been won, to be an average of zero. Note that the (second) jackpot value increment unit may adjust the probability of changing the increment of the second jackpot value into a reduction thereof. Alternatively, the (second) jackpot value increment unit may reduce the second jackpot value when the value has reached a predetermined upper limit, and predetermine the integral of the difference between the first and second jackpot values to be zero over a period during which the first jackpot value would rise from a default value to an upper limit thereof without any jackpot being won. Accordingly, the payout percentage of the progressive jackpot system can be easily determined on the basis of the first jackpot value in the same manner as conventional progressive jackpot systems. In other words, a conventional progressive jackpot system can be easily replaced with the progressive jackpot system of the present invention if the increment rate of the first jackpot value is matched with that of the jackpot value of the conventional progressive jackpot system. Here, the progressive jackpot controller may be linked to two or more groups of the gaming machines, and the increment rates of the second jackpot values may vary with the groups of the gaming machines. As long as the difference between the first and second jackpot values at the time a jackpot has been won is adjusted to be an average of zero in each of the groups, the total payout percentage of the progressive jackpot system is equal to the payout percentage based on the first jackpot value.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

BEST MODE FOR CARRYING OUT THE INVENTION

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
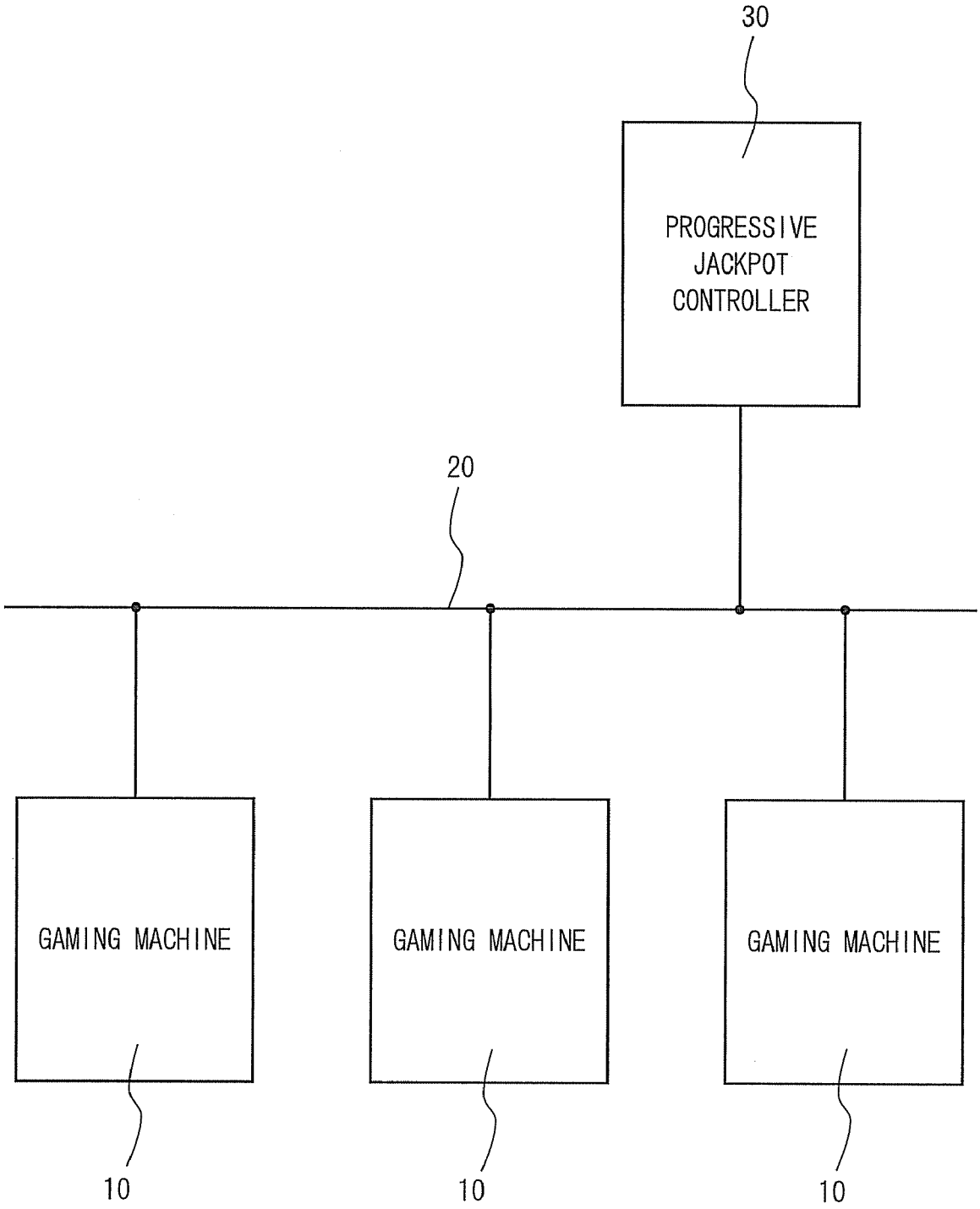
FIG. 1 is a network diagram of a progressive jackpot system according to an embodiment of the present invention.

A progressive jackpot (hereinafter, PJP) system according to an embodiment of the present invention is preferably installed in a casino. As shown in FIG. 1, the PJP system comprises one or more gaming machines 10 and a PJP controller 30, which are linked to each other through a network 20. Here, the PJP controller 30 is preferably separated from all of the gaming machines 10, or alternatively may be installed in one of the gaming machines 10.

Figure 2:
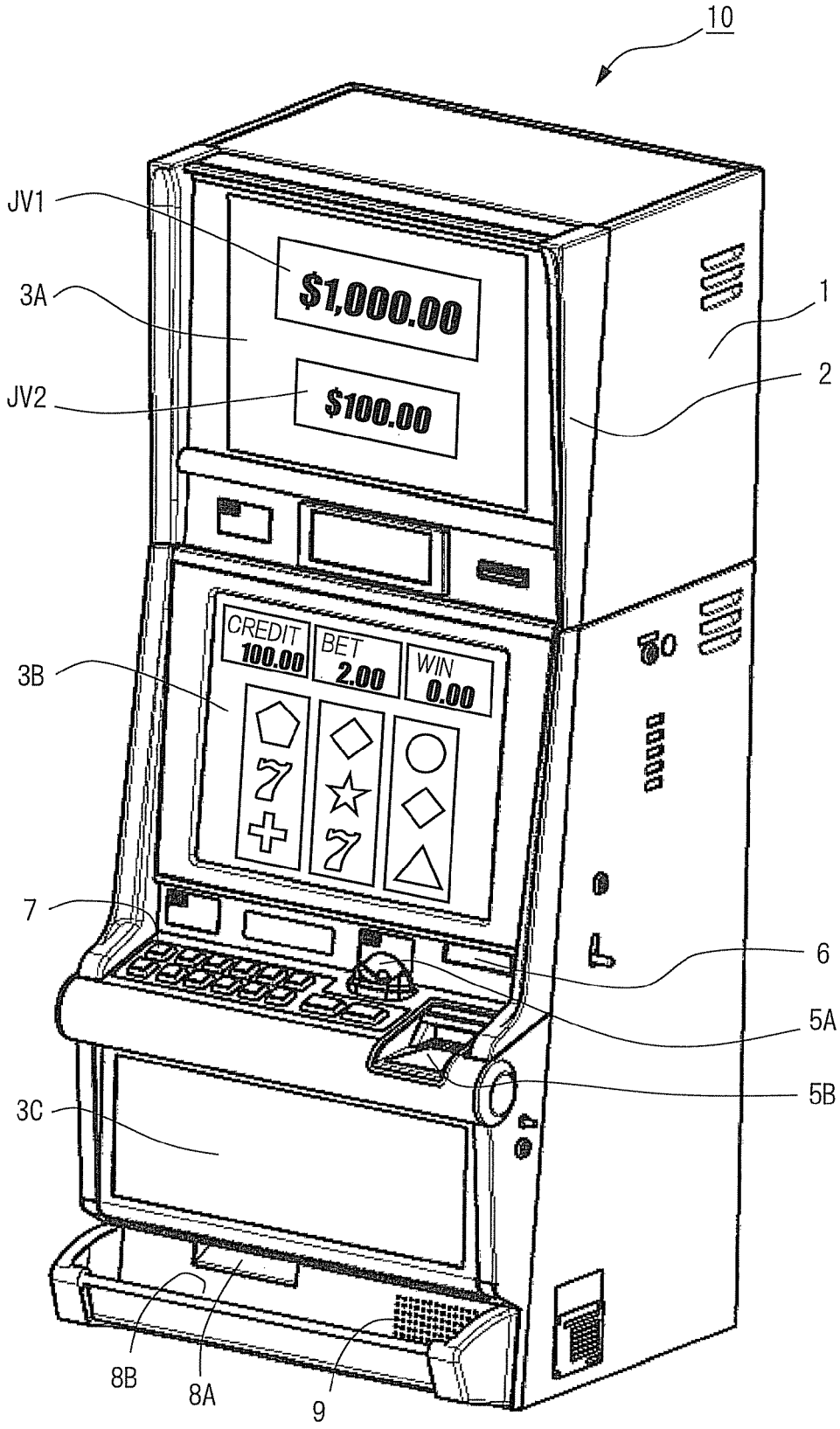
FIG. 2 is a perspective view of a gaming machine shown in FIG. 1.

Each of the gaming machines 10 is preferably a video slot machine shown in FIG. 2, or alternatively, may be a slot machine with mechanical reels, a poker machine, a roulette machine, or other types of gaming machines. The gaming machine 10 comprises a box-shape cabinet 1 with a front panel 2. Three display windows 3A, 3B, and 3C are provided on the upper portion, the middle portion, and the lower portion of the front panel 2, respectively. A coin inlet 5A, a bill/ticket inlet 5B, a ticket outlet 6, and various operation buttons 7 are provided on the front panel 2 between the middle display window 3B and the lower display window 3C. A coin outlet 8A, a coin receiver 8B, and a speaker 9 are installed on the front panel 2 below the lower display window 3C.

The three display windows 3A, 3B, and 3C reproduce various images, for example, images for use in decoration such as the logo of a game developer, images for use in advertisements, images for use in visual effects in games, and visualized information on games such as pay tables, illustrations of game content, and jackpot values. In particular, the upper display window 3A displays two (or more) jackpot meters JV1, JV2 that indicate two (or more) levels of jackpot. The middle display window 3B displays three (or more) symbol columns, the number of available credits of a player, the amount of a bet, and the amount of an award that the player wins.

When the player enters coins and bills into the coin inlet 5A and the bill/ticket inlet 5B, respectively, the validity and counted of the coins and bills will be checked by coin/bill counters installed inside the cabinet 1. The total count of the inserted coins and bills are displayed on the middle windows 3B as player credits. The player may also enter a ticket into the bill/ticket inlet 5B. On the surface of the ticket, the amount of the player's credits is printed with numbers and bar code. The amount of the credits is decoded by a ticket reader installed in the bill/ticket inlet 5B from the bar code printed on the ticket, and then the amount of the credits is displayed on the middle display window 3B.

The player operates the gaming machine 10 by using the buttons 7. For example, the player can select one or more winning lines of the symbol matrix displayed on the middle display window 3B by using one or more buttons 7. The selected winning lines will be shown in the middle display window 3B. The player then enters a bet into the gaming machine 10 by using one or more buttons 7. The bet is placed on each of the selected winning lines. The amount of the bet will be displayed on the middle display window 3B. The player will then push a spin button (one of the buttons 7), and the symbols will start moving in the vertical direction in the middle display window 3B. After that, the player will push one or more stop buttons (included in the buttons 7), and then the symbols will stop column by column. When a winning combination appears on one of the selected winning lines in the stopped symbol matrix, the player will win an award depending on the bet and the probability of the winning combination. The player will then push a payout button (one of the buttons 7), and thereby coins equivalent to the player's credit will be discharged out of the coin outlet 8A from a coin hopper installed in the cabinet 1 and stored in the coin receiver 8B. Alternatively, a ticket will come out of the ticket outlet 6. On the ticket, the amount of the player's credits will be printed in numbers and a bar code by a ticket printer installed in the ticket outlet 6. At the time of the payout, the player can also use the buttons 7 to select either coins or a ticket.

Figure 3:
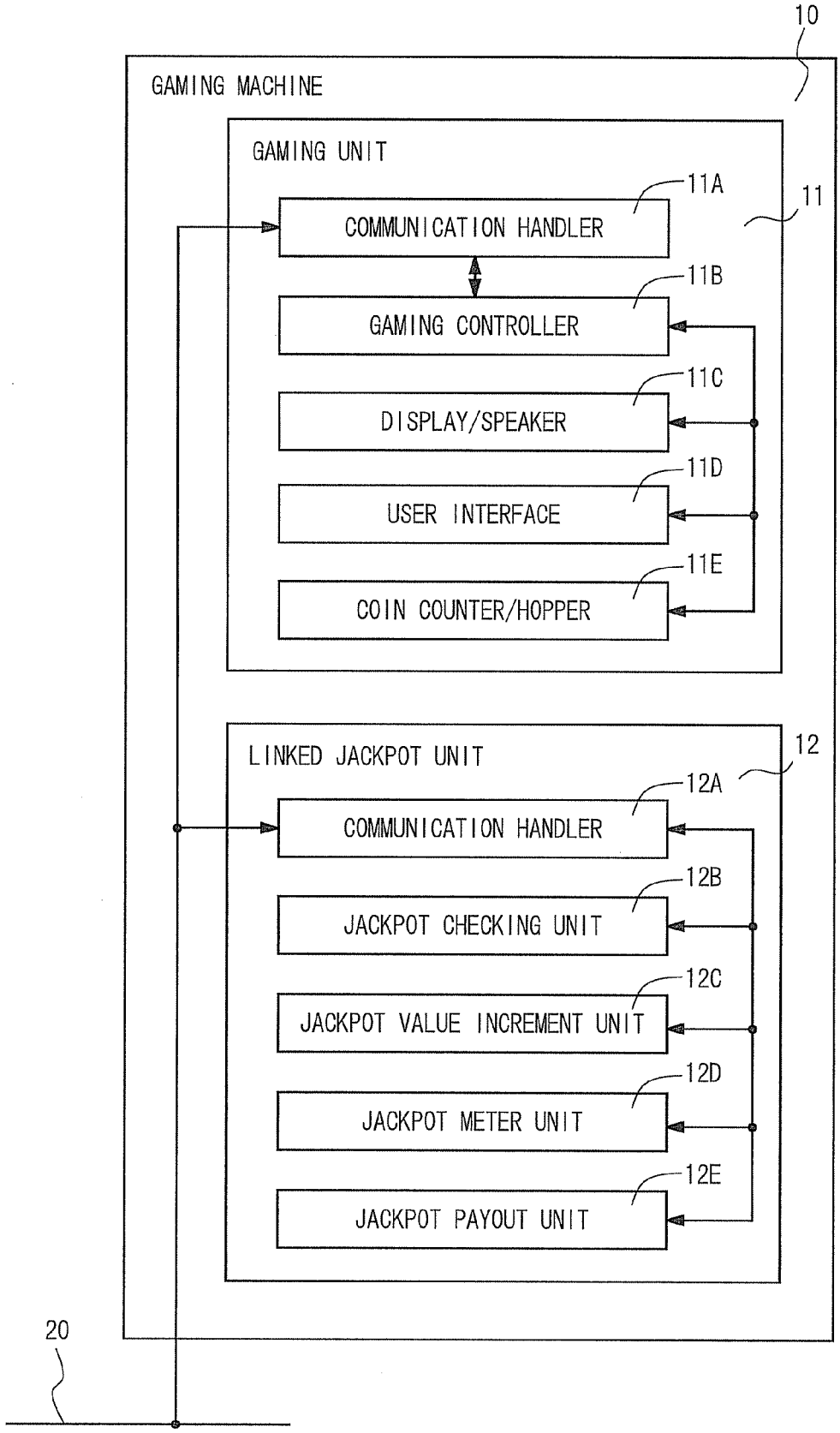
FIG. 3 is a block diagram that shows the configuration of the gaming machine shown in FIG. 1.

The configuration of the gaming machine 10 is mainly divided into a gaming unit 11 and a linked jackpot unit 12 as shown in FIG. 3. Each of the two units 11 and 12 includes a communication handler 11A and 12A, respectively. The communication handlers 11A and 12A link the respective units 11 and 12 to each other and the network 20.

The gaming unit 11 provides gaming functions and visual/sound effects by using control over devices installed in the cabinet 1. As shown in FIG. 3, the gaming unit 11 includes a gaming controller 11B, display/speaker drivers 11C, a user interface 11D, and drivers for a coin counter and a coin hopper 11E. The units 11B-11E are linked to each other through an internal bus. The gaming controller 11B runs various programs and thereby controls other components of the gaming unit 11. In particular, the gaming controller 11B generates random number(s) in a lottery process and uses them in each game. Depending on the random number(s), for example, a winning combination can appear in the stopped symbol matrix displayed on the middle display window 3B. In addition, by using the display/speaker drivers 11C, the gaming controller 11B will control images displayed on the three display windows 3A, 3B, and 3C, and sounds that come out of the speaker 9 (cf. FIG. 2). In particular, the gaming controller 11B will update the jackpot meters JV1 and JV2 displayed on the upper display window 3A, according to the information received from the linked jackpot unit 12 about current jackpot meters. The user interface 11D relays various instructions from the buttons 7 to the gaming controller 11B. The gaming controller 11B manages the amount of the player's credits, which is equivalent to the amount of money inserted into the coin inlet 5A and the bill/ticket inlet 5B and counted by the coin counter 11E (or which the ticket reader decodes from the ticket inserted in the bill/ticket inlet 5B). The gaming controller 11B also performs payout of the player's credits in coins discharged from the coin hopper 11E (or by using a ticket on which the amount of the credits is printed by the ticket printer).

The linked jackpot unit 12 includes a jackpot checking unit 12B, a jackpot value increment unit 12C, a jackpot meter unit 12D, and a jackpot payout unit 12E. The units 12B-12E are preferably realized by a microprocessor executing the respective modules of a program.

The jackpot checking unit 12B monitors the operations of the user interface 11D through the communication handlers 11A and 12A, and thereby informs the PJP controller 30 of each bet placed on the gaming unit 11 by the player. The jackpot checking unit 12B also checks the information from the PJP controller 30 through the communication handler 12A. The information concerns the determination of the PJP controller 30 as to whether or not to provide a jackpot to one of the gaming machines 10 under a lottery process.

The jackpot value increment unit 12C monitors the changes in a first jackpot value generated by the PJP controller 30 through the communication handler 12A and the network 20. The jackpot value increment unit 12C thereby increments a second jackpot value at a rate higher than the increment rate of the first jackpot value in synchronization with the PJP controller 30 incrementing the first jackpot value (details will be described bellow). The jackpot value increment unit 12C further reduces the second jackpot value when the jackpot checking unit 12B detects that the PJP controller 30 has determined to provide a jackpot to one of the gaming machines 10. In addition, the jackpot value increment unit 12C reduces the second jackpot value when the jackpot checking unit 12B has not yet detected that the PJP controller 30 has determined to provide a jackpot for any of the gaming machines, and thereby adjust the difference between the first and second jackpot values at the time a jackpot has been won to be an average of zero. Preferably, the jackpot value increment unit 12C adjusts the probability of changing the increment of the second jackpot value into a reduction thereof. Alternatively, the jackpot value increment unit 12C may reduce the second jackpot value when the value has reached a predetermined upper limit, and predetermine the integral of the difference between the first and second jackpot values to be zero over a period during which the first jackpot value rises from a default value to an upper limit thereof without any jackpot being won. In each case, the jackpot value increment unit 12C preferably resets the second jackpot value to a default value. Alternatively, if no jackpot has been won, the jackpot value increment unit 12C may temporarily decrement the second jackpot value by a small amount.

The jackpot meter unit 12D updates image data of the jackpot meters based on the second jackpot value, and sends current image data of the jackpot meters back to the gaming unit 11.

When the jackpot checking unit 12B detects that the PJP controller 30 has determined to provide a jackpot to the gaming machine 10 including the jackpot checking unit 12B, the jackpot payout unit 12E produces an output that indicates that a jackpot has been won through the communication handler 12A and the gaming unit 11. In particular, the award amount of the jackpot is determined from the second jackpot value. Here, when two or more levels of jackpot are set (e.g., the two levels displayed in the jackpot meters JV1 and JV2 shown in FIG. 2), one pair of the first and second jackpot values are prepared for each of the levels of jackpot. Under the instruction of the jackpot payout unit 12E, the gaming controller 11B informs the player that he/she has won the jackpot, and then increases the player's credits by the number corresponding to the values displayed in the jackpot meter JV1 or JV2, i.e., the amount of the award determined from the second jackpot value.

Figure 4:
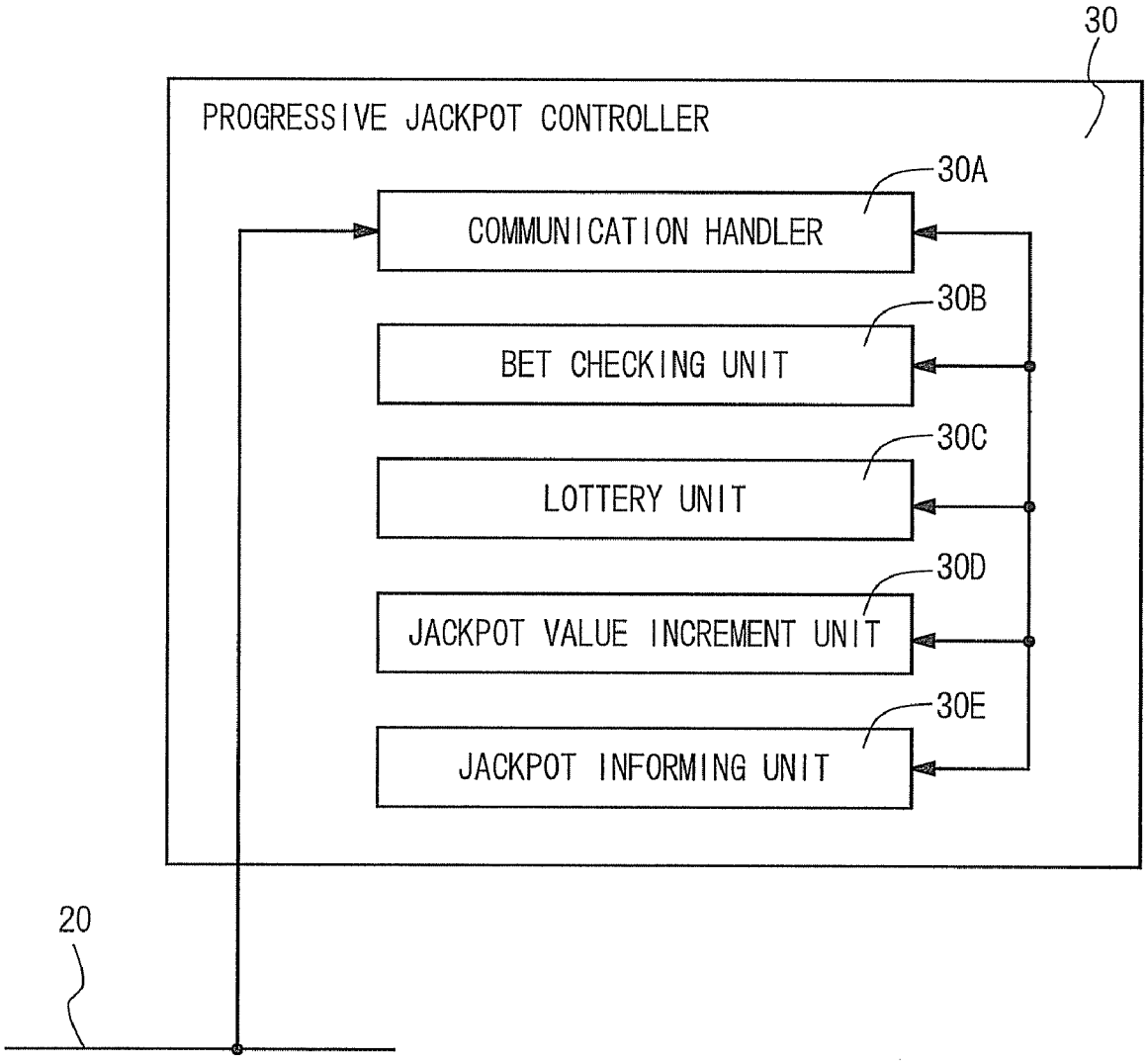
FIG. 4 is a block diagram that shows the configuration of a progressive jackpot controller shown in FIG. 1.

The configuration of the PJP controller 30 comprises a communication handler 30A, a bet checking unit 30B, a lottery unit 30C, a jackpot value increment unit 30D, and a jackpot informing unit 30E, as shown in FIG. 4. The communication handler 30A links the units 30B-30E to the network 20. The units 30B-30E are preferably realized by a microprocessor executing the respective modules of a program.

The bet checking unit 30B monitors the information from the jackpot checking units 12B of the gaming machines 10 through the communication handler 30A and the network 20. The information concerns a bet placed on any of the gaming machines 10 by one or more players. The bet checking unit 30B detects each bet from the information.

The lottery unit 30C performs a lottery process each time the bet checking unit 30B detects a bet placed on any of the gaming machines 10, and thereby determines whether or not to provide a jackpot to one of the gaming machines 10. The lottery process is independent of any of the lottery processes of the gaming machines 10.

The jackpot value increment unit 30D increments the first jackpot value by an amount each time the bet checking unit 30B detects a bet placed on any of the gaming machines 10. The amount is equal to a percentage of every detected bet, which is predetermined from a desired payout percentage of the PJP system in a manner similar to that of the prior art. The jackpot value increment unit 30D continues to increment the first jackpot value until the lottery unit 30C determines to provide a jackpot. When the lottery unit 30C has determine to provide a jackpot, the jackpot value increment unit 30D then resets the first jackpot value to a default value, like conventional PJP systems.

The jackpot informing unit 30E monitors the operations of the lottery unit 30C, and thereby informs one of the gaming machines 10 that it has won a jackpot when the lottery unit 30C has determined to provide the jackpot to the gaming machine. The information is also received by the jackpot value increment unit 30D.

Figure 5A:
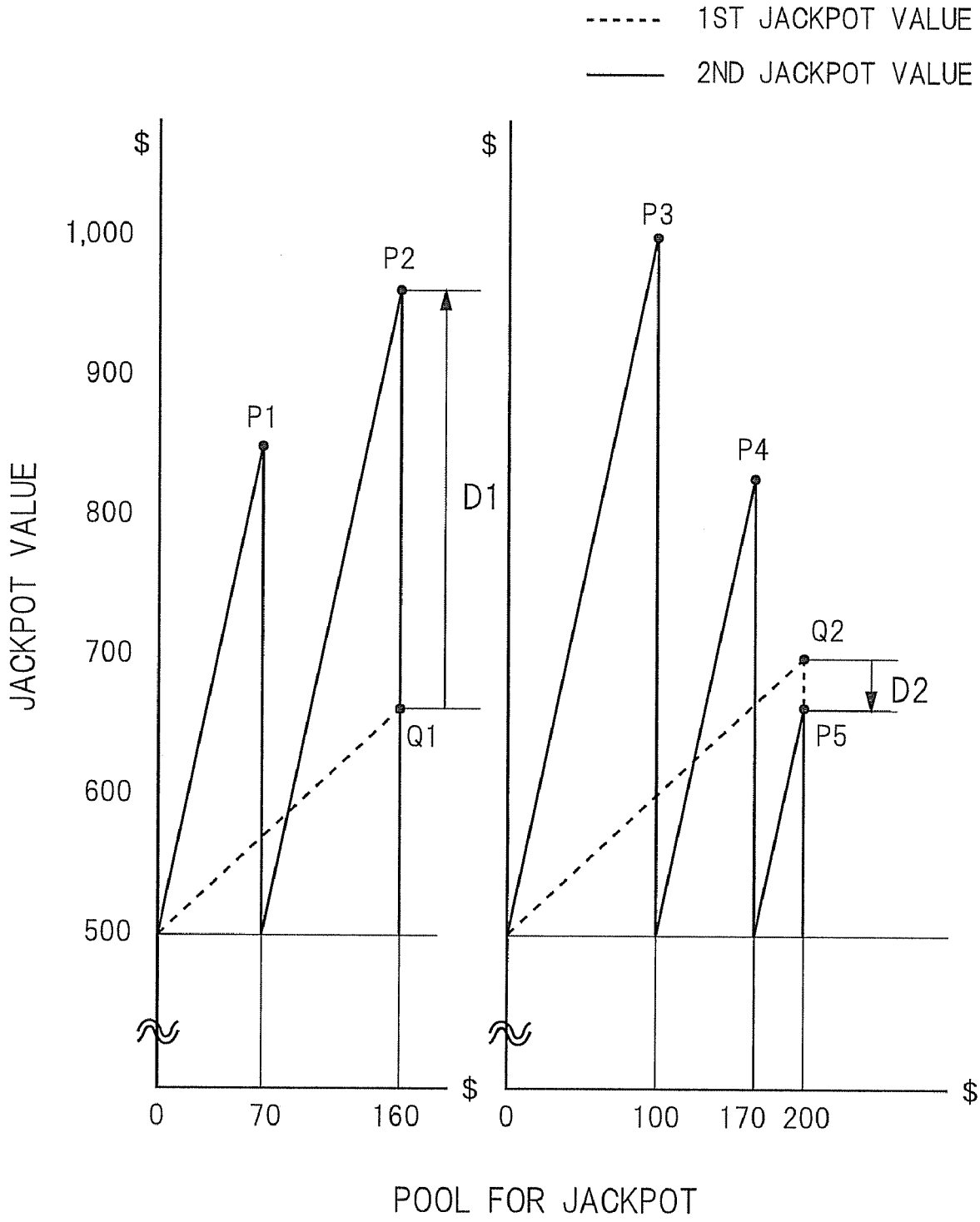
FIG. 5 is a graph that shows the relationship between first and second jackpot values used in the progressive jackpot system according to the embodiment of the present invention.
Figure 5B:
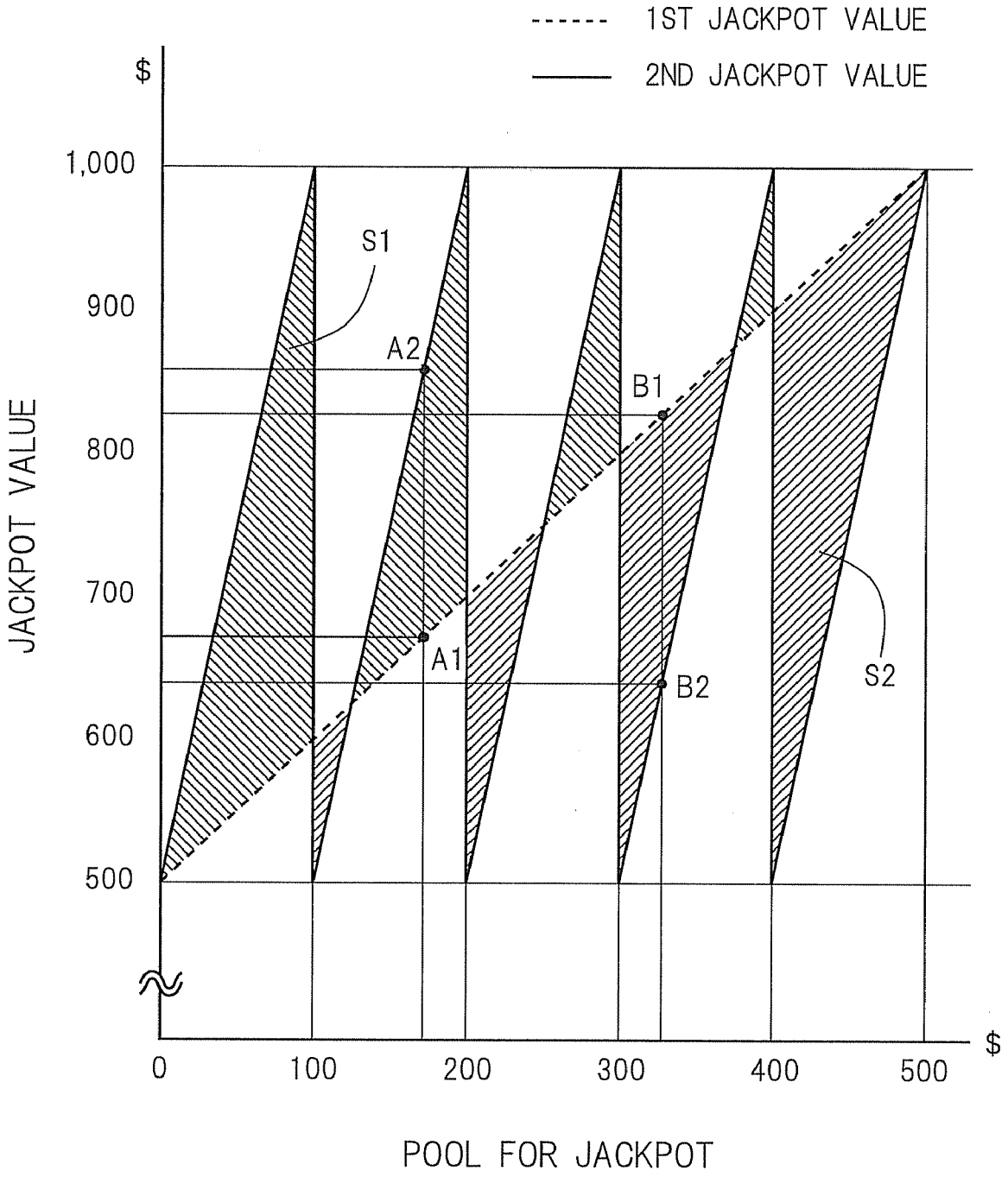

The above-described PJP system preferably increments the first and second jackpot values as follows. The jackpot value increment unit 30D of the PJP controller 30 (hereinafter, the first jackpot value increment unit) puts a percentage of each bet placed on any of the gaming machines 10 into a pool for a jackpot. The first jackpot value increment unit 30D further increments the first jackpot value from a default value (e.g. $500) to an upper limit (e.g. $1,000) at the same rate as the value of the jackpot pool (see the broken line shown in FIGS. 5A and 5B). On the other hand, the jackpot value increment unit 12C of each of the gaming machines 10 (hereinafter, the second jackpot value increment unit) increments the second jackpot value from a default value (e.g. $500) at a pace that is faster than the value of the jackpot pool, or the first jackpot value (see the solid lines shown in FIGS. 5A and 5B). In FIGS. 5A and 5B, for example, the increment rate of the second jackpot value is $500 per $100, which is five times as high as that of the first jackpot value ($100 per $100).

The first jackpot value increment unit 30D reduces the first jackpot value only when the PJP controller 30 has determined to provide a jackpot for one of the gaming machine 10. On the other hand, the second jackpot value increment unit 12C reduces the second jackpot value, even if the PJP controller 30 has not yet determined to provide a jackpot for any of the gaming machines.

Preferably, the second jackpot value increment unit 12C stochastically changes the increment of the second jackpot value into a reduction thereof (cf. FIG. 5A). Preferably, the second jackpot value increment unit 12C generates one or more random numbers, and uses them in the stochastic determination that the second jackpot value is to be reduced. In the left portion of FIG. 5A, the second jackpot value is reset to the default value (e.g., $500) when it has reached a point P1 (e.g. $850), even if no jackpot has been won. The second jackpot value is then incremented from the default value (e.g. $500) at a faster rate ($500 per $100). When the first and second jackpot values reach points Q1 (e.g. $660) and P2 (e.g. $950), respectively, the PJP controller 30 has determined to provide a jackpot for one of the gaming machines 1. Both the first and second jackpot values are then reset to the respective default values (e.g. $500). Here, the second jackpot value at the point P2 is higher than the first jackpot value at the point Q1, and accordingly, the difference therebetween is a negative value D1 (e.g. $290), which is a loss to the casino. In the next round of the increment, as shown in the right portion of FIG. 5A, the second jackpot value is reset to the default value ($500) when it has reached a point P3 (e.g. $1,000), even if no jackpot has been won. The second jackpot value is then incremented from the default value ($500) at a faster rate ($500 per $100). The second jackpot value is again reset to the default value ($500) when it has reached a point P4 (e.g. about $170), even if no jackpot has been won. The second jackpot value is then incremented from the default value ($500) at the faster rate ($500 per $100). When the first and second jackpot values reach points Q2 (e.g. $700) and P5 (e.g. $650), respectively, the PJP controller 30 has determined to provide another jackpot for one of the gaming machines 1. Both the first and second jackpot values are then reset to the respective default values ($500). Here, the second jackpot value at the point P5 is lower than the first jackpot value at the point Q2, and accordingly, the difference therebetween is a positive value D2 (e.g. $50), which is a gain to the casino.

The difference between the first and second jackpot values at the time a jackpot has been won averages (D1+D2)/2 per round of the increment of the jackpot values. The average difference is a gain or loss per round to the casino. In FIG. 5A, the casino loses ($290−$50)/2=$120 per round. The second jackpot value increment unit 12C stochastically determines the points P1, P3, and P4, where the second jackpot value has been reset without any jackpot being won. The second jackpot value increment unit 12C further adjusts the probability of the reset of the second jackpot value, thereby adjusting the average difference to be zero. For example, if the average difference is positive, the probability is lowered (i.e., the second jackpot value tends to rise to a higher level), and vice versa. Note that the second jackpot value increment unit 12C may vary the increment rate or the default value of the second jackpot value each round of the increment of the jackpot values in order to adjust the average difference to be zero. If the average difference is maintained at zero, the actual payout percentage of the PJP system can be matched with the payout percentage of any conventional PJP system, which is based on the first jackpot value.

Alternatively, the second jackpot value increment unit 12C may fix the upper limit of the second jackpot value at the same value as the upper limit of the first jackpot value (e.g. $1,000) (see the solid lines shown in FIG. 5B). When the second jackpot value has reached the upper limit ($1,000) until a jackpot is won, the second jackpot value increment unit 12C resets the second jackpot value to the default value ($500) even if no jackpot has been won. The second jackpot value increment unit 12C then restarts the incrementing of the second jackpot value from the default value ($500) at the faster rate ($500 per $100). The second jackpot value increment unit 12C repeats the above-described operations until a jackpot is won or the first jackpot value reaches the upper limit (e.g. $1,000).

In this case, the actual payout percentage of the PJP system can be also matched with the payout percentage of any conventional PJP system, which is based on the first jackpot value. Indeed, the integral of the difference between the first and second jackpot values is predetermined to be equal to zero over the period during which the first jackpot value would rise from the default value to the upper limit without any jackpot being won. In other words, the area of the hatched region S1 shown in FIG. 5B is equal to that of the other hatched region S2 shown in FIG. 5B. Note that the expectation value of an award amount of a jackpot is proportional to the area of the region surrounded by the line showing the incremented jackpot value, the vertical and horizontal axes, and the vertical line indicating the upper limit of the jackpot pool, since the probability of a jackpot per unit of bet is common between the first and second jackpot values (Note that the probability of a jackpot per unit of bet may vary with the values of the jackpot pool). In FIG. 5B, the expectation values of an award amount of a jackpot are equal between the first and second jackpot values. For example, in the case where a jackpot has been won at the time when the second jackpot value is at the point A2, the actual award paid for the jackpot is larger than the first jackpot value at the point A1. On the other hand, in the case where a jackpot has been won at the time when the second jackpot value is at the point B2, the actual award paid for the jackpot is smaller than the first jackpot value at the point B1. The difference between the first jackpot value at the point A1 and the second jackpot value at the point A2 can compensate for the difference between the first jackpot value at the point B1 and the second jackpot value at the point B2. Thus, the average value to be paid for a jackpot is unchanged. Accordingly, the payout percentage of the PJP system can be easily matched with that of any of the conventional PJP systems.

The increment rate of the first jackpot value is equal to that of the pool for jackpot, and accordingly limited by a desired payoff percentage of the PJP system, like conventional PJP systems. On the other hand, the increment rate of the second jackpot value is essentially free from the desired payout percentage, i.e., it is allowed to be sufficiently higher than the percentage of bet put into the pool for jackpot. Accordingly, the second jackpot value requires a fewer number of plays on the gaming machines 10 than the first jackpot value in order to return to a sufficiently high level after a jackpot has been won. The higher the jackpot value is, the more players will be attracted to play games on the gaming machines 10. As a result, the second jackpot value can be increased at a remarkably quicker pace than the jackpot values of conventional PJP systems. In addition to that, the second jackpot value may, in general, peak two or more times until a jackpot is won, in contrast to the first jackpot value. Thus, the above-described progressive jackpot system allows players to maintain their motivation to play on the gaming machines 10 immediately after a jackpot has been won, and thereby reduce the period of time during which the second jackpot value is low, and thus improves the occupancy rates of the gaming machines 10.

As long as the average difference (cf. FIG. 5A) or the integral (cf. FIG. 5B) is maintained to be zero, the second jackpot value may rise at a different increment rate and from a different default value than the second jackpot value shown in FIGS. 5A and 5B. Alternatively, immediately after the second jackpot value has reached the upper limit, if no jackpot has been won, the jackpot value increment unit 12C may temporarily decrement the second jackpot value by a small amount.

The gaming machines 10 linked to the PJP controller 30 may be divided into two or more groups. In this case, the increment rates or the default values of the second jackpot values may vary with the groups of the gaming machines. As long as the above-described average difference or integral is adjusted to be zero in each of the groups, the total payout percentage of the PJP system is equal to the payout percentage based on the first jackpot value.

Figure 6:
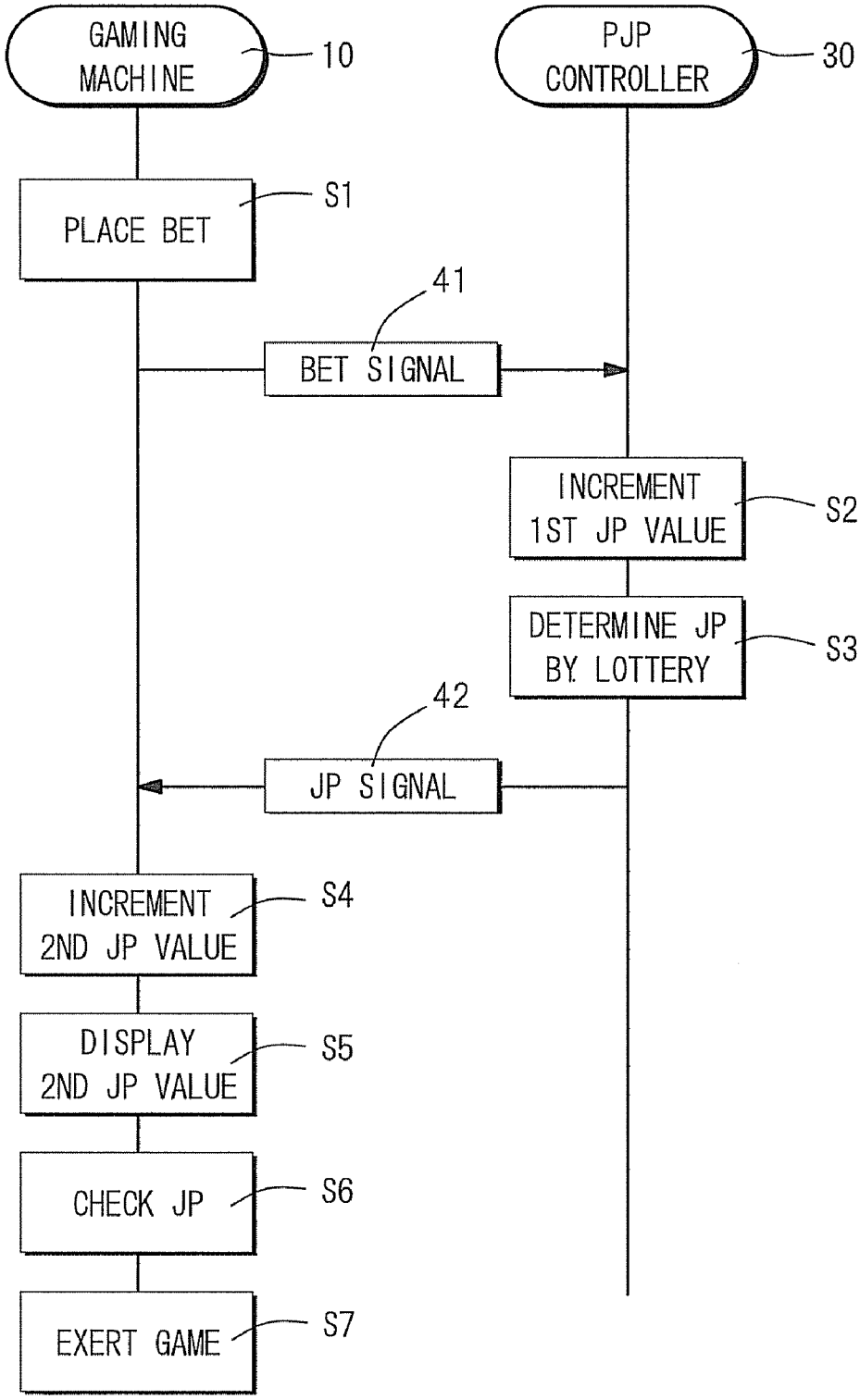
FIG. 6 is a flow chart that shows processes executed by the gaming machine and the progressive jackpot controller shown in FIGS. 3 and 4.

In the above-described embodiment of the present invention, each of the gaming machines 10 and the PJP controller 30 collaborate with each other and increment the first and second jackpot values according to the following steps S1-S7 in a flow chart shown in FIG. 6.

STEP S1: A player places a bet on one of the gaming machines 10 through the user interface 11D (cf. FIG. 3). The jackpot checking unit 12B of the gaming machine 10 detects the bet, and informs the PJP controller 30 of the bet by using a bet signal 41.

STEP S2: The bet checking unit 30B of the PJP controller 30 receives the bet signals 41 from the jackpot checking units 12B of the gaming machines 10 through the communication handler 30A. The bet checking unit 30B then detects each bet from the bet signals 41. The first jackpot value increment unit 30D increments the first jackpot value by a specific amount each time the bet checking unit 30B detects a bet (cf. the broken lines shown in FIGS. 5A and 5B).

STEP S3: The lottery unit 30C of the PJP controller 30 performs a lottery process each time the bet checking unit 30B detects a bet, and thereby determines whether or not to provide a jackpot to one of the gaming machines 10. The jackpot informing unit 30E informs the gaming machines 10 of the determination by using a jackpot (JP) signal 42. In particular, the jackpot informing unit 30E informs one of the gaming machines 10 that it has won a jackpot when the lottery unit 30C has determined to provide the jackpot to the gaming machine. On the other hand, when receiving the information about the winning of a jackpot, the first jackpot value increment unit 30D resets the first jackpot value to the default value (e.g. $500 as shown in FIGS. 5A and 5B). The JP signal 42 also indicates the change in the first jackpot value (an increment or a reset thereof) made by the first jackpot value increment unit 30D. The JP signal 42 may include the updated first jackpot value itself.

STEP S4: The second jackpot value increment unit 12C receives the JP signals 42 from the PJP controller 30 through the communication handler 12A, and monitors the changes of the first jackpot value generated by the first jackpot value increment unit 30D by using the JP signals 42. The second jackpot value increment unit 12C thereby increments the second jackpot value at a rate higher than the increment rate of the first jackpot value in synchronization with the first jackpot value increment unit 30D.

The second jackpot value increment unit 12C further reduces the second jackpot value in the stochastic or deterministic manner shown in FIG. 5A or 5B, respectively. When the second jackpot value increment unit 12C has generated a random number falling within a predetermined range, or the second jackpot value has reached the upper limit, the second jackpot value increment unit 12C resets the second jackpot value to the default value even if no jackpot has been won.

STEP S5: Each time the second jackpot value increment unit 12C increments the second jackpot value, the jackpot meter unit 12D updates image data of the jackpot meters based on the second jackpot value. The jackpot meter unit 12D then sends current image data of the jackpot meters to the gaming unit 11. By using the display/speaker drivers 11C, the gaming controller 11B controls images displayed on the upper display window 3A, and thereby updates the jackpot meters JV1 and JV2 according to the current image data.

STEP S6: The jackpot checking unit 12B receives the JP signals 42 and checks the information on the determination of the lottery unit 30C as to whether or not to provide a jackpot to one of the gaming machines 10. The information is then sent to the jackpot payout unit 12E and the second jackpot value increment unit 12C.

When the jackpot checking unit 12B detects that the lottery unit 30C has determined to provide a jackpot to one of the gaming machines 10 linked thereto, the second jackpot value increment unit 12C resets the second jackpot value to the default value. In the case where the second jackpot value is reduced in the stochastic manner shown in FIG. 5A, the second jackpot value increment unit 12C updates the average difference between the first and second jackpot values at the time a jackpot has been won, and then adjusts the probability of changing the increment of the second jackpot value into a reduction thereof, such that the average difference is zero. Note that other devices may update the average difference and adjust the probability, instead of the second jackpot value increment unit 12C.

When the jackpot checking unit 12B detects that the lottery unit 30C has determined to provide a jackpot to the gaming machine 10 including the jackpot checking unit 12B, the jackpot payout unit 12E produces an output that indicates the winning of the jackpot through the gaming unit 11. Under the instructions of the jackpot payout unit 12E, the gaming controller 11B uses the display/speaker drivers 11C to produce visual effects displayed on the three display windows 3A, 3B, and 3C, and sound effects come out of the speaker 9, and thereby inform a player that he/she has won the jackpot. The gaming controller 11B then increases the player's credits by the number corresponding to the values displayed in the jackpot meter JV1 or JV2, i.e., the amount of the award determined from the current second jackpot value.

STEP S7: The gaming controller 11B executes its own gaming processes, i.e., generates random number(s) in a lottery process, controls the images of the moving and stopped symbols depending on the random number(s), produces visual and sound effects by using the display windows 3A-3C and the speaker 9, and provides awards depending on the winning combinations appearing in the winning lines selected by a player.

The steps S1-S7 are repeated in each game on the gaming machines 1. Moreover, the steps S4-S6 are repeated each time the jackpot checking unit 12B receives a JP signal 42, independent of the game process on the gaming machine 1.

In the above-described embodiment of the present invention, the PJP controller 30 increments the first jackpot value, and each of the gaming machine 10 increments the second jackpot value. Alternatively, the PJP controller 30 may increment both the first and second jackpot values according to the following embodiment of the present invention.

A PJP system according to this embodiment of the present invention comprises components similar to those of the above-described PJP system shown in FIGS. 1-4 except for the following points: the jackpot value increment unit 30B of the PJP controller 30 increments both the first and second jackpot values; and the jackpot meter unit 12D of each of the gaming machines 10 monitors the second jackpot value changed by the jackpot value increment unit 30B of the PJP controller 30 through the communication handler 12A and the network 20. Note that the jackpot value increment units 12C may be eliminated from the linked jackpot units 12 of the gaming machines 10. A description of the details of similar components and the first and second jackpot values of the present invention can be found in the description of the PJP system shown in FIGS. 1-4.

Figure 7:
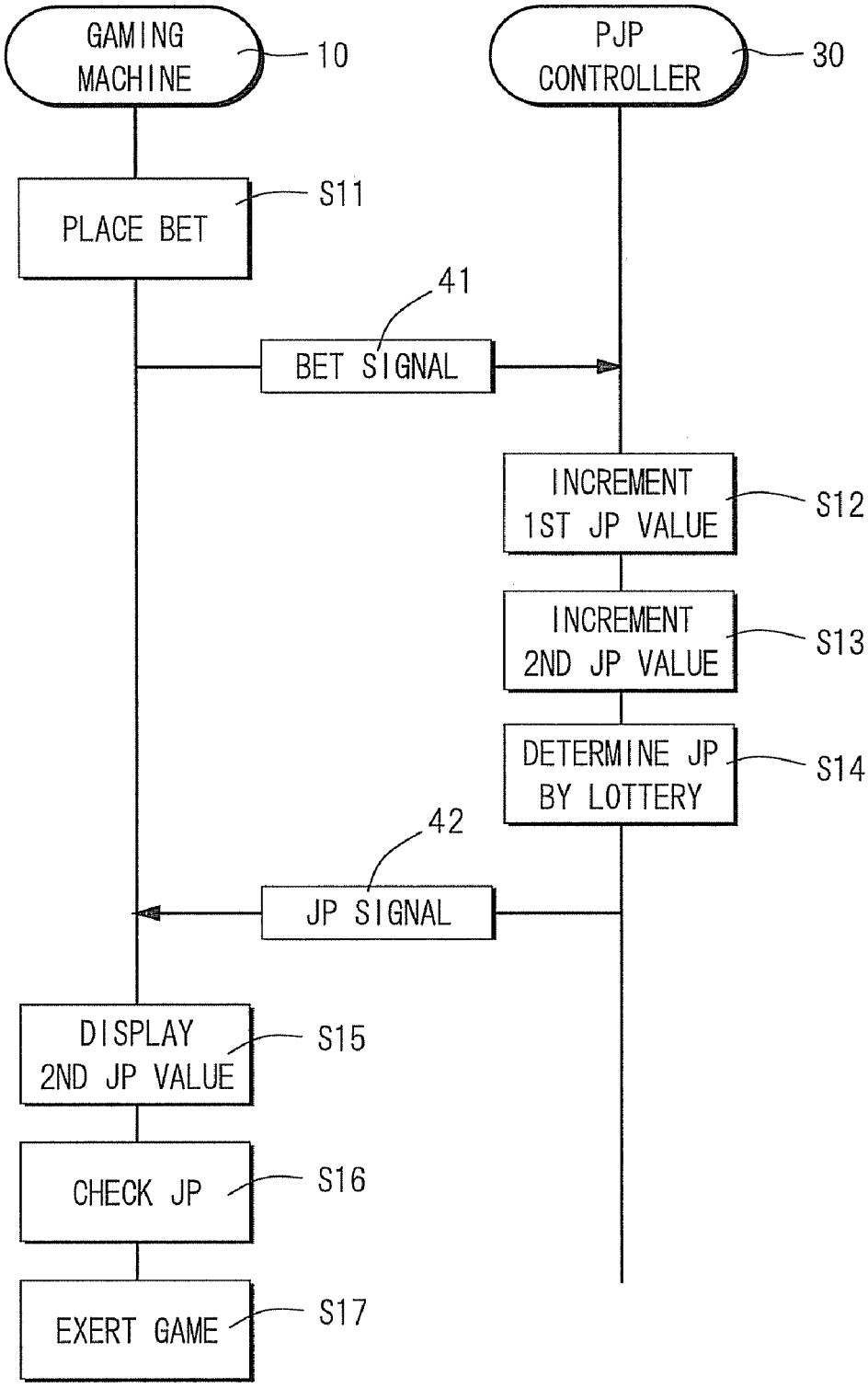
FIG. 7 is a flow chart of processes of a gaming machine and a progressive jackpot controller included in a progressive jackpot system according to another embodiment of the present invention.

Each of the gaming machines 10 and the PJP controller 30 collaborate with each other, and increment the first and second jackpot values according to the following steps S11-S17 in a flow chart shown in FIG. 7.

STEP S11: A player places a bet on one of the gaming machines 10 through the user interface 11D (cf. FIG. 3). The jackpot checking unit 12B of the gaming machine 10 detects the bet, and informs the PJP controller 30 of the bet by using a bet signal 41.

STEP S12: The bet checking unit 30B of the PJP controller 30 receives the bet signals 41 from the jackpot checking units 12B of the gaming machines 10 through the communication handler 30A. The bet checking unit 30B then detects each bet from the bet signals 41. The jackpot value increment unit 30D of the PJP controller 30 increments the first jackpot value by a specific amount each time the bet checking unit 30B detects a bet (cf., the broken lines shown in FIGS. 5A and 5B).

STEP S13: At the same time, the jackpot value increment unit 30D also increments the second jackpot value at a rate higher than the increment rate of the first jackpot value. The jackpot value increment unit 30D further reduces the second jackpot value in the stochastic or deterministic manner shown in FIG. 5A or 5B, respectively. When the jackpot value increment unit 30D has generated a random number falling within a predetermined range, or the second jackpot value has reached the upper limit, the jackpot value increment unit 30D resets the second jackpot value to the default value even if no jackpot has been won.

STEP S14: The lottery unit 30C of the PJP controller 30 performs a lottery process each time the bet checking unit 30B detects a bet, and thereby determines whether or not to provide a jackpot to one of the gaming machines 10. The jackpot informing unit 30E informs the gaming machines 10 of the determination by using a JP signal 42. In particular, the jackpot informing unit 30E informs one of the gaming machines 10 that it has won a jackpot when the lottery unit 30C has determined to provide the jackpot to the gaming machine. The JP signal 42 also indicates the current second jackpot value.

The jackpot value increment unit 30D further reduces the second jackpot value in the stochastic or deterministic manner shown in FIG. 5A or 5B, respectively. When the jackpot value increment unit 30D has generated a random number falling within a predetermined range, or the second jackpot value has reached the upper limit, the jackpot value increment unit 30D resets the second jackpot value to the default value even if no jackpot has been won.

When the lottery unit 30C has determined to provide a jackpot to one of the gaming machines 10 linked thereto, the jackpot value increment unit 30D resets both the first and second jackpot values to the respective default values ($500 in FIGS. 5A and 5B). In the case where the second jackpot value is reduced in the stochastic manner shown in FIG. 5A, the jackpot value increment unit 30D updates the average difference between the first and second jackpot values at the time a jackpot has been won, and then adjusts the probability of changing the increment of the second jackpot value into a reduction thereof, such that the average difference is zero. Note that other devices may update the average difference and adjust the probability, instead of the jackpot value increment unit 30D.

STEP S15: The jackpot meter unit 12D of each of the gaming machines 10 receives the JP signal 42 and detects the second jackpot value from the JP signals 42. The jackpot meter unit 12D thereby updates image data of the jackpot meters based on the detected second jackpot value each time the jackpot value increment unit 30D increments the second jackpot value. The jackpot meter unit 12D then sends current image data of the jackpot meters to the gaming unit 11. By using the display/speaker drivers 11C, the gaming controller 11B controls images displayed on the upper display window 3A, and thereby updates the jackpot meters JV1 and JV2 according to the current image data.

STEP S16: The jackpot checking unit 12B receives the JP signals 42 and checks the information on the determination of the lottery unit 30C as to whether or not to provide a jackpot to one of the gaming machines 10. The information is then sent to the jackpot payout unit 12E. When the jackpot checking unit 12B detects that the lottery unit 30C has determined to provide a jackpot to the gaming machine 10 including the jackpot checking unit 12B, the jackpot payout unit 12E and the gaming controller 11B operate in a manner similar to that at the step S6 shown in FIG. 6. Thus, they inform a player that he/she has won the jackpot and increases the player's credits by the number corresponding to the amount of the award determined from the current second jackpot value.

STEP S17: The gaming controller 11B executes its own gaming processes in a manner similar to that at the step S7 shown in FIG. 6.

General Interpretation of Terms

In understanding the scope of the present invention, the term "configured" as used herein to describe a component, section or part of a device includes hardware and/or software that is constructed and/or programmed to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A gaming machine linked to a progressive jackpot controller comprising:

a jackpot checking unit configured to inform the progressive jackpot controller of a bet placed by a player, and check whether or not the progressive jackpot controller has determined to provide the jackpot to one of the gaming machines linked thereto;

a jackpot value increment unit configured to monitor the changes in a first jackpot value made by the progressive jackpot controller and increment a second jackpot value at a higher rate than the increment rate of the first jackpot value in synchronization with the progressive jackpot controller, reset the second jackpot value at determined intervals to a predetermined default value even if no jackpot has been paid out, and reduce the second jackpot value when the jackpot checking unit detects that the progressive jackpot controller has determined to provide the jackpot to one of the gaming machines linked thereto;

a jackpot meter unit configured to display the second jackpot value; and a jackpot payout unit configured to produce an output that indicates that a jackpot of the second jackpot value has been won when the jackpot checking unit detects that the progressive jackpot controller has determined to provide the jackpot to the gaming machine including the jackpot payout unit.

2. A gaming machine according to claim 1, wherein the jackpot value increment unit stochasitically changes the second jackpot value when the jackpot checking unit has not yet detected that the progressive jackpot controller had determined to provide a jackpot for any gaming machine linked thereto, thereby adjusting the difference between the first and second jackpot values at the time when a jackpot has been won to be an average of zero.

3. A gaming machine according to claim 1, wherein the jackpot value increment unit alternatingly increases the second jackpot value at determined intervals and resets the second jackpot values at determined intervals.

4. A gaming machine according to claim 1, wherein the jackpot value increment unit resets the second jackpot value in response to the second jackpot value reaching a predetermined upper limit, and predetermines the integral of the difference between the first and second jackpot values to be zero over a period during which the first jackpot value rises from a default value to an upper limit thereof without any jackpot being won.

5. A gaming machine according to claim 1, wherein the jackpot value increment unit varies one of the increment rate and the default value of the second jackpot value each time the jackpot checking unit detects that the progressive jackpot controller provides the jackpot for one of gaming machines linked thereto.

6. A progressive jackpot controller linked to a plurality of separate gaming machines comprising:

a bet checking unit configured to detect a bet placed by a player on any of the gaming machines;

a lottery unit configured to determine whether or not to provide a jackpot to one of the gaming machines under a lottery process each time the bet checking unit detects the bet;

a jackpot value increment unit configured to increment first and second jackpot values at lower and higher rates, respectively, each time the bet checking unit detects a bet, and reduce both the first and second jackpot values when the lottery unit has determined to provide the jackpot to one of the gaming machines;

resetting the second jackpot value at determined intervals to a predetermined default value even if no jackpot has been paid out; and a jackpot informing unit configured to inform one of the gaming machines that it has won a jackpot of the second jackpot value, after the lottery unit has determined to provide the jackpot to the gaming machine.

7. A progressive jackpot controller according to claim 6, wherein the jackpot value increment unit stochasitically changes the second jackpot value when the lottery unit has not yet determined to provide the jackpot for any gaming machine linked thereto, thereby adjusting the difference between the first and second jackpot values at the time when a jackpot has been won to be an average of zero.

8. A progressive jackpot controller according to claim 6, wherein the jackpot value increment unit alternatingly increases the second jackpot value at determined intervals and decreases the second jackpot values at determined intervals.

9. A progressive jackpot controller according to claim 7, wherein the jackpot value increment unit resets the second jackpot value in response to the second jackpot value reaching a predetermined upper limit, and predetermines the integral of the difference between the first and second jackpot values to be zero over a period during which the first jackpot value rises from a default value to an upper limit thereof without any jackpot being won.

10. A progressive jackpot controller according to claim 6, wherein the jackpot value increment unit varies one of the increment rate and a default value of the second jackpot value each time the lottery unit provides the jackpot to one of the gaming machines.

11. A progressive jackpot controller according to claim 6, wherein the progressive jackpot controller is linked to at least two groups of the gaming machines, and the jackpot value increment unit varies one of the increment rates and the default values of the second jackpot values for the groups of the gaming machines.

12. A progressive jackpot system comprising a plurality of gaming machines and a progressive jackpot controller that are linked to each other, the progressive jackpot controller comprising:

a bet checking unit configured to detect a bet placed by a player on any of the gaming machines;

a lottery unit configured to determine whether or not to provide a jackpot to one of the gaming machines under a lottery process each time the bet checking unit detects a bet;

a first jackpot value increment unit configured to increment a first jackpot value at a predetermined rate each time the bet checking unit detects a bet, and reduce the first jackpot value when the lottery unit has determined to provide the jackpot to one of the gaming machines;

resetting the second jackpot value at determined intervals to a predetermined default value even if no jackpot has been paid out; and a jackpot informing unit configured to inform one of the gaming machines that it has won a jackpot after the lottery unit has determined provide the jackpot to the gaming machine; and each of the gaming machines comprising:

a jackpot checking unit configured to inform the progressive jackpot controller of a bet placed by a player, and check the information from the jackpot informing unit of the progressive jackpot controller as to whether or not the lottery unit of the progressive jackpot controller has determined to provide the jackpot to one of the gaming machines;

a second jackpot value increment unit configured to monitor the changes in the first jackpot value made by the first jackpot value increment unit of the progressive jackpot controller, and increment a second jackpot value at a higher rate than the increment rate of the first jackpot value in synchronization with the first jackpot value increment unit, and reduce the second jackpot value when the jackpot checking unit detects that the lottery unit of the progressive jackpot controller has determined to provide the jackpot to one of gaming machines;

a jackpot meter unit configured to display the second jackpot value; and a jackpot payout unit configured to produce an output that indicates the winning of a jackpot of the second jackpot value after the jackpot checking unit detects that the lottery unit of the progressive jackpot controller has determined to provide the jackpot to the gaming machine including the jackpot payout unit.

13. A progressive jackpot system comprising a plurality of gaming machines and a progressive jackpot controller that are linked to each other, the progressive jackpot controller comprising:

a bet checking unit that detects a bet placed by a player on any of the gaming machines;

a lottery unit that determines whether or not to provide a jackpot to one of the gaming machines under a lottery process each time the bet checking unit detects a bet;

a jackpot value increment unit that increments first and second jackpot values at lower and higher rates, respectively, each time the bet checking unit detects a bet, and reduce both the first and second jackpot values when the lottery unit has determined to provide the jackpot to one of the gaming machines;

resetting the second jackpot value at determined intervals to a predetermined default value even if no jackpot has been paid out; and a jackpot informing unit configured to inform one of the gaming machines that it has won a jackpot of the second jackpot value, after the lottery unit has determined to provide the jackpot to the gaming machine; and each of the gaming machines comprising:

a jackpot checking unit that informs the progressive jackpot controller of a bet placed by a player, and checks the information from the jackpot informing unit of the progressive jackpot controller as to whether or not the lottery unit of the progressive jackpot controller has determined to provide the jackpot to one of the gaming machines;

a jackpot meter unit that monitors and displays the second jackpot value changed by the jackpot value increment unit of the progressive jackpot controller; and a jackpot payout unit that produces an output that indicates the winning of a jackpot of the second jackpot value when the jackpot checking unit detects that the lottery unit of the progressive jackpot controller has determined to provide the jackpot to the gaming machine including the jackpot payout unit.

14. A method of playing games on a progressive jackpot system comprising a plurality of gaming machines and a progressive jackpot controller that are linked to each other, the method comprising steps of:

detecting a bet placed by a player on any of the gaming machines by using the progressive jackpot controller;

incrementing a first jackpot value at a predetermined rate by using the progressive jackpot controller each time the progressive jackpot controller detects a bet;

incrementing a second jackpot value at a higher rate than that of the first jackpot value by using each of the gaming machines in synchronization with the progressive jackpot controller;

resetting the second jackpot value at determined intervals to a predetermined default value even if no jackpot has been paid out;

displaying the second jackpot value on each of the gaming machines;

deciding whether or not to provide a jackpot to one of the gaming machines under a lottery process of the progressive jackpot controller each time the progressive jackpot controller detects a bet;

producing an output that indicates the winning of a jackpot of the second jackpot value by using one of the gaming machines after having determined to provide the jackpot to the gaming machine under the lottery process of the progressive jackpot controller; and reducing the first and second jackpot values by using the progressive jackpot controller and each of the gaming machines, respectively, when the jackpot has been determined to be provided to one of the gaming machines under the lottery process of the progressive jackpot controller.

15. A method of playing games on a progressive jackpot system comprising a plurality of gaming machines and a progressive jackpot controller that are linked to each other, the method comprising steps of:

detecting a bet placed by a player on any of the gaming machines by using the progressive jackpot controller;

incrementing first and second jackpot values at lower and higher rates, respectively, by using the progressive jackpot controller each time the progressive jackpot controller detects a bet;

resetting the second jackpot value at determined intervals to a predetermined default value even if no jackpot has been paid out;

displaying the second jackpot value on each of the gaming machines;

deciding whether or not to provide a jackpot to one of the gaming machines under a lottery process of the progressive jackpot controller each time the progressive jackpot controller detects a bet;

producing an output that indicates the winning of a jackpot of the second jackpot value by using one of the gaming machines after having determined to provide the jackpot to the gaming machine under the lottery process of the progressive jackpot controller; and reducing the first and second jackpot values by using the progressive jackpot controller when the jackpot has been determined to provide for one of gaming machines under the lottery process of the progressive jackpot controller.

16. A progressive jackpot gaming program product executed by a gaming machine electronically linked to a progressive jackpot controller via a network, the program product being embodied in a computer readable medium and comprising computer instructions for:

informing the progressive jackpot controller of a bet placed by a player;

checking whether or not the progressive jackpot controller has determined to provide a jackpot to one of a plurality of gaming machines liked thereto;

monitoring the changes of a first jackpot value made by the progressive jackpot controller, and incrementing a second jackpot value at a higher rate than the increment rate of the first jackpot value in synchronization with the progressive jackpot controller;

resetting the second jackpot value at determined intervals to a predetermined default value even if no jackpot has been paid out;

reducing the second jackpot value when detecting that the progressive jackpot controller has determined to provide a jackpot to one of gaming machines linked thereto;

displaying the second jackpot value on the gaming machine; and producing an output that indicates the winning of a jackpot of the second jackpot value when detecting that the progressive jackpot controller has determined to provide the jackpot to the gaming machine that executes the program product.

17. A progressive jackpot gaming program product executed by a progressive jackpot controller linked to a plurality of gaming machines, the program product being embodied in a computer readable medium and comprising computer instructions for:

detecting a bet placed by a player on any of the gaming machines;

incrementing first and second jackpot values at lower and higher rates, respectively, each time a bet is detected;

deciding whether or not to provide a jackpot to one of the gaming machines under a lottery process each time a bet is detected;

resetting the second jackpot value at determined intervals to a predetermined default value even if no jackpot has been paid out;

reducing the first and second jackpot values when having determined to provide a jackpot to one of the gaming machines under the lottery process; and informing one of the gaming machines that it has won a jackpot of the second jackpot value, after having determined to provide the jackpot to the gaming machine.

* * * * *